US006359537B1

(12) United States Patent
Ichikawa et al.

(10) Patent No.: US 6,359,537 B1
(45) Date of Patent: Mar. 19, 2002

(54) ELECTROMAGNETIC RELAY, METHOD OF ADJUSTING THE SAME, AND METHOD OF ASSEMBLING THE SAME

(75) Inventors: Kazuhiro Ichikawa; Tatsumi Ide, both of Tokyo; Tsutomu Ono, Iwate; Yosinori Sugawara, Iwate; Toshiaki Chiba, Iwate; Tosiyuki Gotou, Iwate, all of (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/558,272

(22) Filed: Apr. 25, 2000

(30) Foreign Application Priority Data

Apr. 27, 1999 (JP) ..... 11-119271

(51) Int. Cl.[7] ..... H01H 51/22

(52) U.S. Cl. ..... 335/85; 335/78; 335/81; 335/86

(58) Field of Search ..... 335/78–86, 132

(56) References Cited

U.S. PATENT DOCUMENTS 5,519,369 A * 5/1996 Hendel ..... 335/85

5,894,253 A 4/1999 Ichikawa et al. ..... 335/78

FOREIGN PATENT DOCUMENTS

JP 6-139891 5/1994

* cited by examiner

*Primary Examiner*—Ramon M. Barrera
(74) *Attorney, Agent, or Firm*—Hayes, Soloway, Hennessey, Grossman & Hage P.C.

(57) ABSTRACT

A electromagnetic relay includes a spool, a coil, a U-shaped yoke, an armature, a movable contact, a pair of stationary contacts, and a taper. The spool has an inner hole and first and second flange portions formed at its two ends. The coil is wound on the spool. The yoke is locked at the flange portions of the spool by press fitting to stride over the coil. The armature is movably connected to one end of the yoke and positioned to extend through the inner hole of the spool. The movable contact is attached to move in an interlocked manner with the armature. The pair of stationary contacts are arranged to sandwich the movable contact. The taper is formed on at least one of press-fit locking surfaces of one end of the yoke and the first flange portion, and has a locking force that increases as being closer to a vicinity of the inner hole of the spool. A method of adjusting an electromagnetic relay, and a method of assembling an electromagnetic relay are also disclosed.

21 Claims, 14 Drawing Sheets

ELECTROMAGNETIC RELAY, METHOD OF ADJUSTING THE SAME, AND METHOD OF ASSEMBLING THE SAME

BACKGROUND OF THE INVENTION

The present invention relates to an electromagnetic relay and a method of adjusting the same and, more particularly, to an electromagnetic relay having such a structure that facilitates adjustment of a contact follow, a method of adjusting the same, and a method of assembling the same.

U.S. Pat. No. 5,894,253 (reference 1) discloses a conventional electromagnetic relay, particularly, a high-breakdown-voltage electromagnetic relay suitable for high-load use for an automobile wiper, power window, or the like.

This electromagnetic relay has a basic structure in which a yoke having a U-shaped section is press-fitted and fixed in a spool wound with a coil. Flange portions are formed on the two ends of the spool, and projections that determine the upper limit of press fitting of the yoke project from the flange portions toward a hollow portion in the spool. Ear-like projections are formed on the two side surfaces of each of the two upright portions of the yoke. The yoke and the flange portions of the spool are positioned by using the two side surfaces of the ear-like projections as the press-fit surfaces that abut against the wall surfaces in the flange portions of the spool, and the two abutting surfaces above the press-fit surfaces.

An armature having a movable contact extends through the hollow portion of the spool, and one end of the armature is connected to one end of the yoke through a hinge spring. Stationary contact terminals formed on the upper and lower surfaces of the movable contact are press-fitted and fixed in the spool. As a result, the number of components is decreased and the assembly process is simplified, thereby reducing the manufacturing cost.

The conventional electromagnetic relay described above is based on a technique having an assumption that the spool and the yoke are mutually positioned precisely. A possibility of variations in contact follow due to the assembly precision or assembly variations is not described at all. The contact follow is a distance through which the armature moves after the making side contact is closed. Factors that cause the variations in contact follow are firstly variations in press-fit position of the yoke and the bending precision of the magnetic pole surface of the yoke, secondly variations in built-in positions of the spool and the terminals, and thirdly the warp of the spring which occurs when caulking the armature and the movable spring.

When the contact follow varies, the service life of the electromagnetic relay becomes unstable. The variations in contact follow cause variations in contact travel, leading to variations in working voltage. Therefore, in order to further stabilize the service life and the working voltage, adjustment of the contact follow during or after assembly is sought for so that the contact follow becomes stable.

Even if the yoke and the spool are assembled with high positioning precision, the contact follow may vary due to various reasons as described above, and final adjustment is accordingly indispensable. In particular, this adjustment need be performed easily and simply, and an arrangement for realizing such an electromagnetic relay, a method of adjusting the same, and a method of assembling the same are sought for.

SUMMARY OF THE INVENTION

It is an object of the present invention to provide an electromagnetic relay in which positioning adjustment of a yoke can be facilitated, a method of adjusting the same, and a method of assembling the same.

In order to achieve the above object, according to the present invention, there is provided an electromagnetic relay comprising a spool having a hollow portion and first and second flange portions formed at two ends thereof, a coil wound on the spool, a U-shaped yoke locked at the flange portions of the spool by press fitting to stride over the coil, an armature movably connected to one end of the yoke and positioned to extend through the hollow portion of the spool, a movable contact attached to move in an interlocked manner with the armature, a pair of stationary contacts arranged to sandwich the movable contact, and a first taper portion formed on at least one of press-fit locking surfaces of one end of the yoke and the first flange portion and having a locking force that increases as being closer to a vicinity of the hollow portion of the spool.

DESCRIPTION OF THE PREFERRED EMBODIMENTS

The present invention will be described in detail with reference to the accompanying drawings.

First, the structure of an electromagnetic relay according to one embodiment of the present invention will be described with reference to FIGS. 1 to 5.

Figure 1:
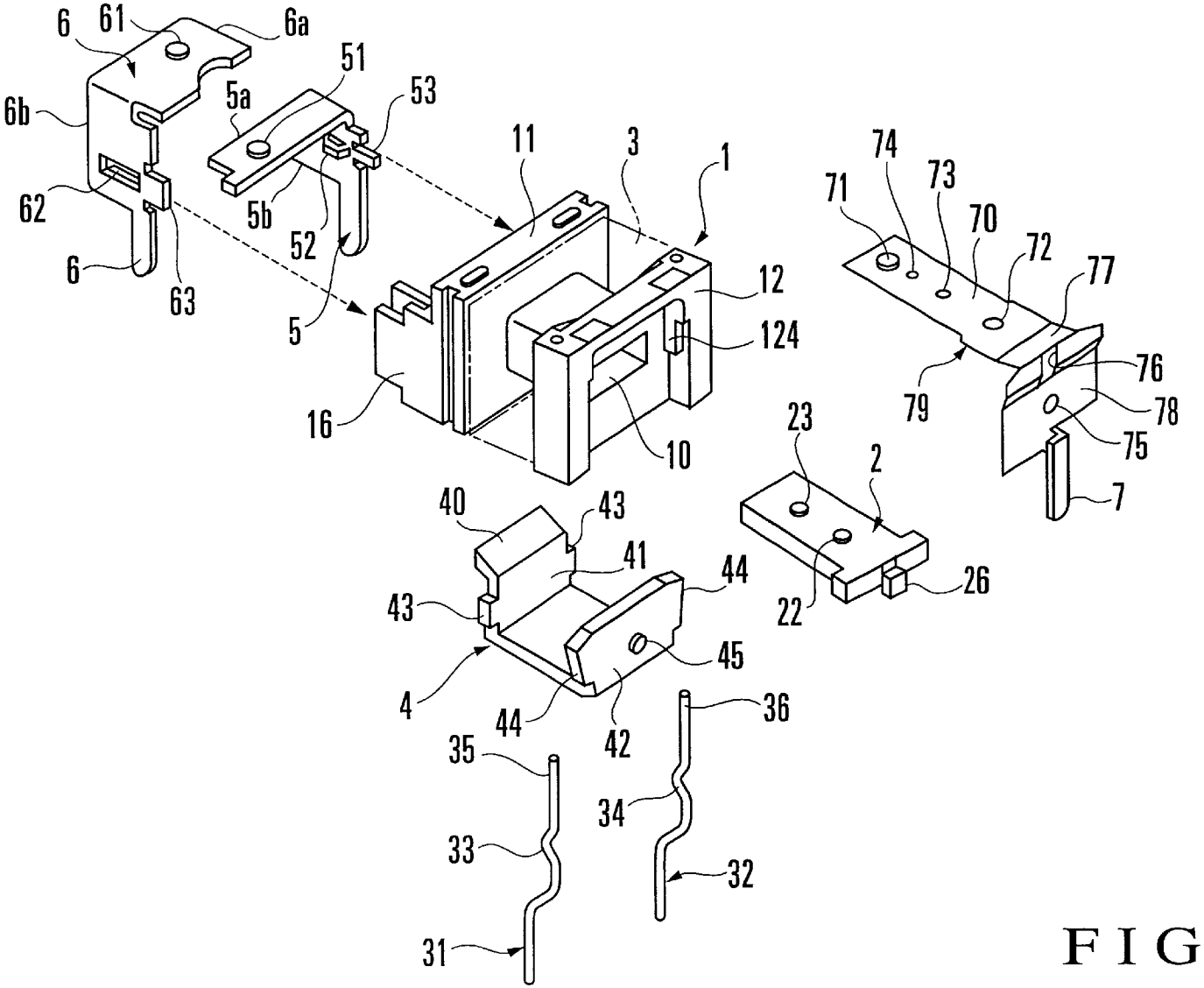
FIG. 1 is an exploded perspective view of an electromagnetic relay according to the first embodiment of the present invention.
Figure 2:
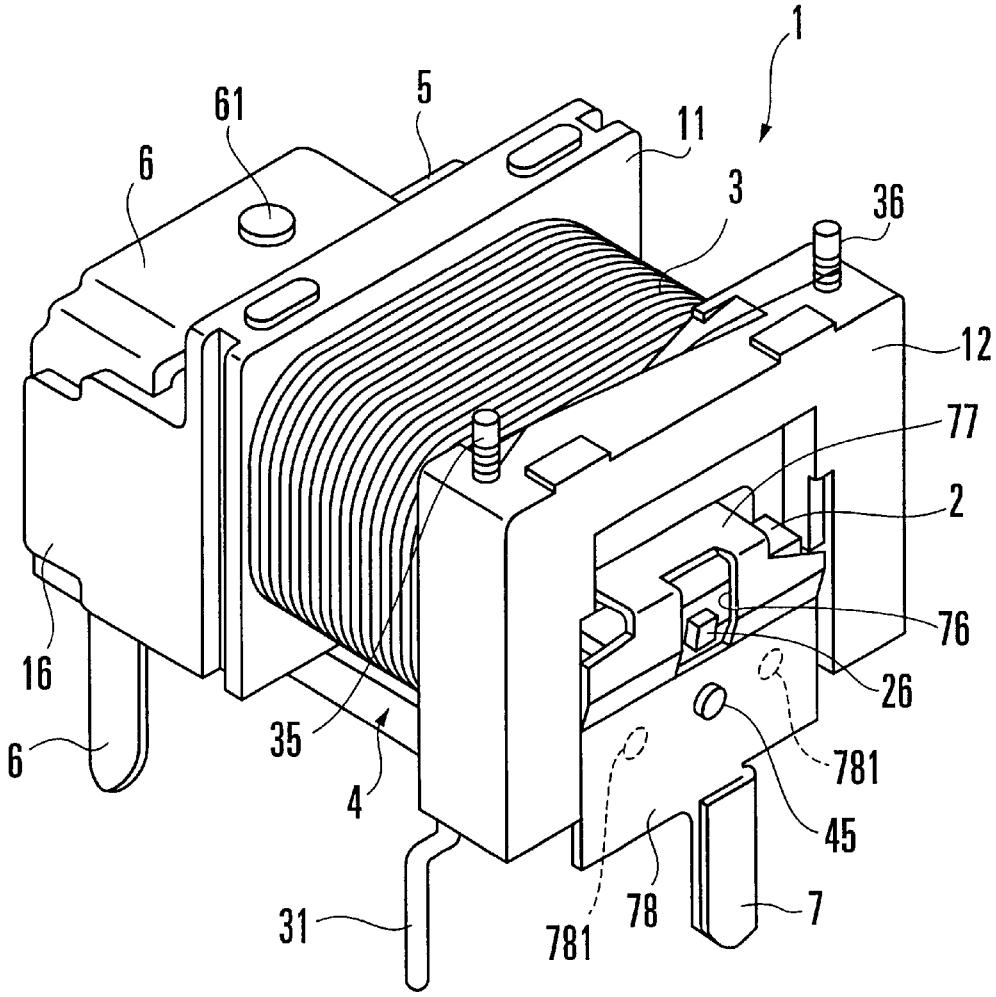
FIG. 2 is a perspective view of the electromagnetic relay shown in FIG. 1 after assembly.

A spool 1 having a rectangular section is molded from an insulating member such as a thermoplastic resin, and has an inner hole 10. As shown in FIGS. 1 and 2, the spool 1 has flange portions 11 and 12 on its two ends. A pair of coil terminals 31 and 32 are fixed to one flange portion 12 by press fitting. Coil tie-up portions 35 and 36 at the distal ends of the coil terminals 31 and 32 project from the upper end face of the flange portion 12. One end of a coil wire is tied up on the input-side coil tie-up portion 36, and is wound on the spool 1 by a predetermined number of times. Then, the other end of the wire is tied up on the output-side coil tie-up portion 35, thereby forming a coil bobbin.

As shown in FIG. 1, a yoke 4 with a substantially U-shaped section is made by bending a plate member having a high magnetic permeability, e.g., pure iron. An upright portion 41 on the distal end side of the yoke 4, i.e., on the stationary contact side of the electromagnetic relay, is further bent outward at its distal end to form a magnetic pole surface 40. A circular projecting portion 45 to fit with a hinge spring 80 is formed on an upright portion 42 on the rear end side of the yoke 4, i.e., on the coil terminal side of the electromagnetic relay. Ear-like projections 43 and 44 projecting from the two side portions of the two opposing upright portions 41 and 42 are press-fitted on the inner surfaces of the flange portions 11 and 12 of the spool 1 and temporarily fixed to them.

Figure 3:
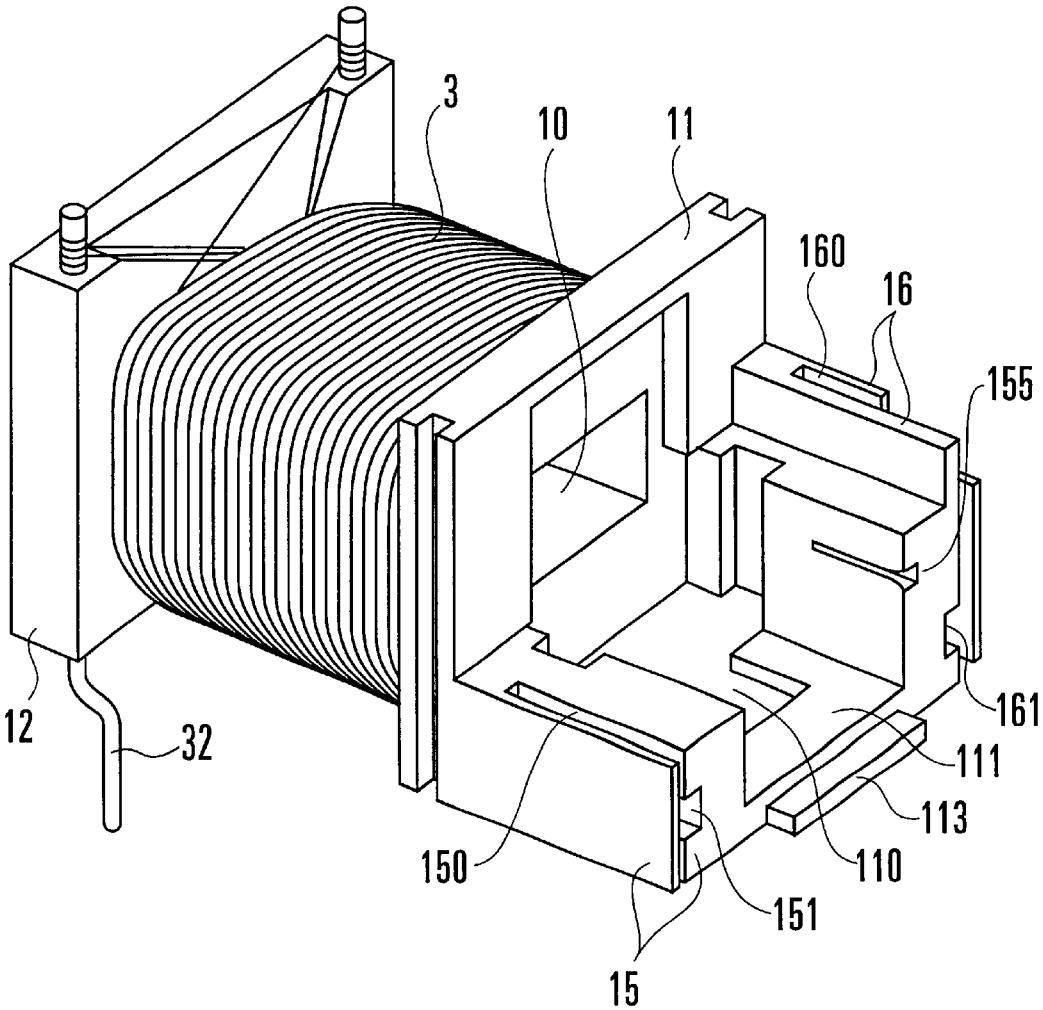
FIG. 3 is a perspective view of the electromagnetic relay shown in FIG. 1 during assembly seen from the opposite side to that of FIG. 2.

FIG. 3 shows the contact-side flange portion 11 in detail. In the contact-side flange portion 11, stationary terminal support portions 15 and 16 are integrally formed with the spool 1, and the respective support portions 15 and 16 are formed with slits 150 and 160 in which the terminals are to be inserted.

As shown in FIG. 1, a pair of substantially L-shaped stationary contact terminals 5 and 6 formed of a high-conductive lead frame member such as a copper plate are comprised of contact support portions 5*a* and 6a having caulked stationary contacts 51 and 61, and terminal fixing portions 5*b* and 6*b* having cantilevered cut-and-raised tongue pieces 52 and 62. The terminal fixing portions 5*b* and 6*b* are respectively fixed in the slits 150 and 160 by press fitting so that the tongue pieces 52 and 62 respectively engage with positioning guide grooves 151 and 161 formed in the support portions 15 and 16 shown in FIG. 3.

Figure 4:
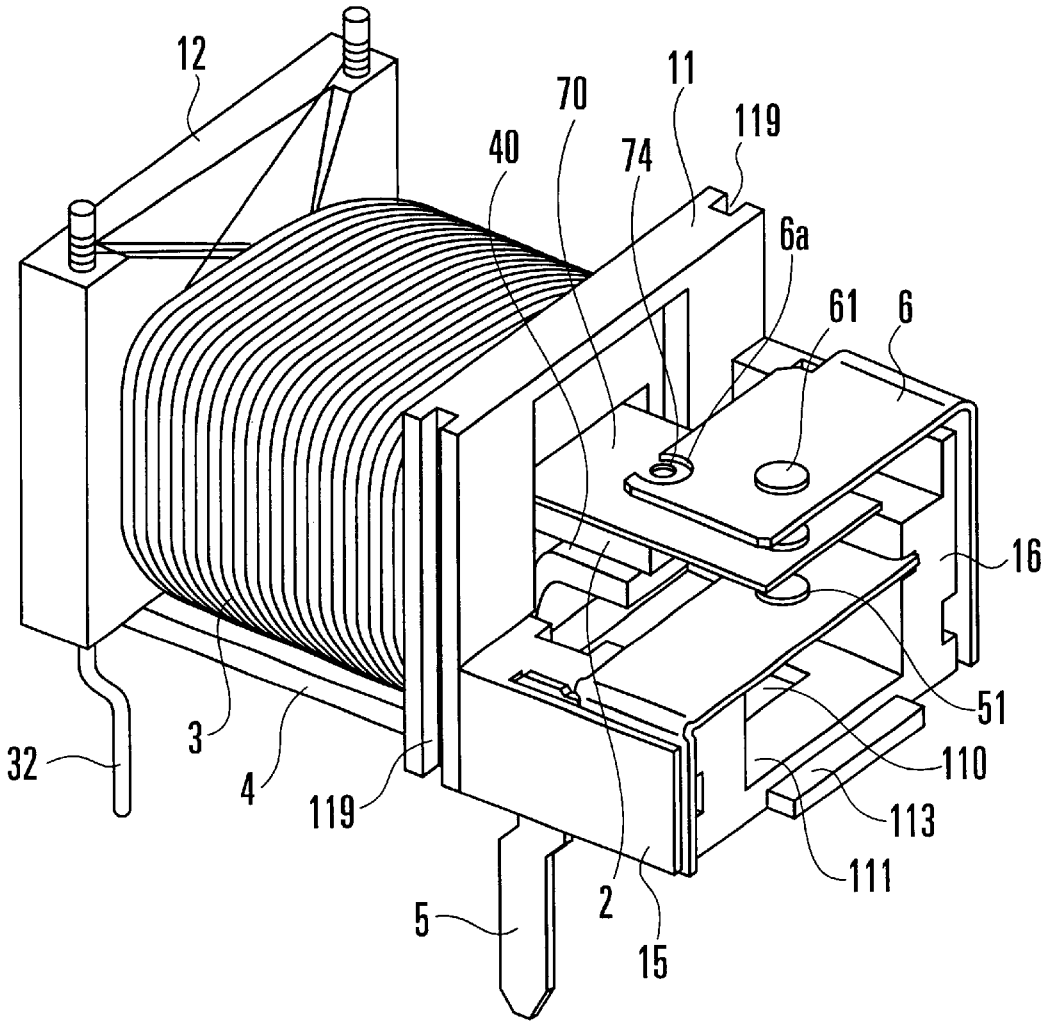
FIG. 4 is a perspective view of the electromagnetic relay shown in FIG. 1 after assembly seen from the stationary contact side.
Figure 5:
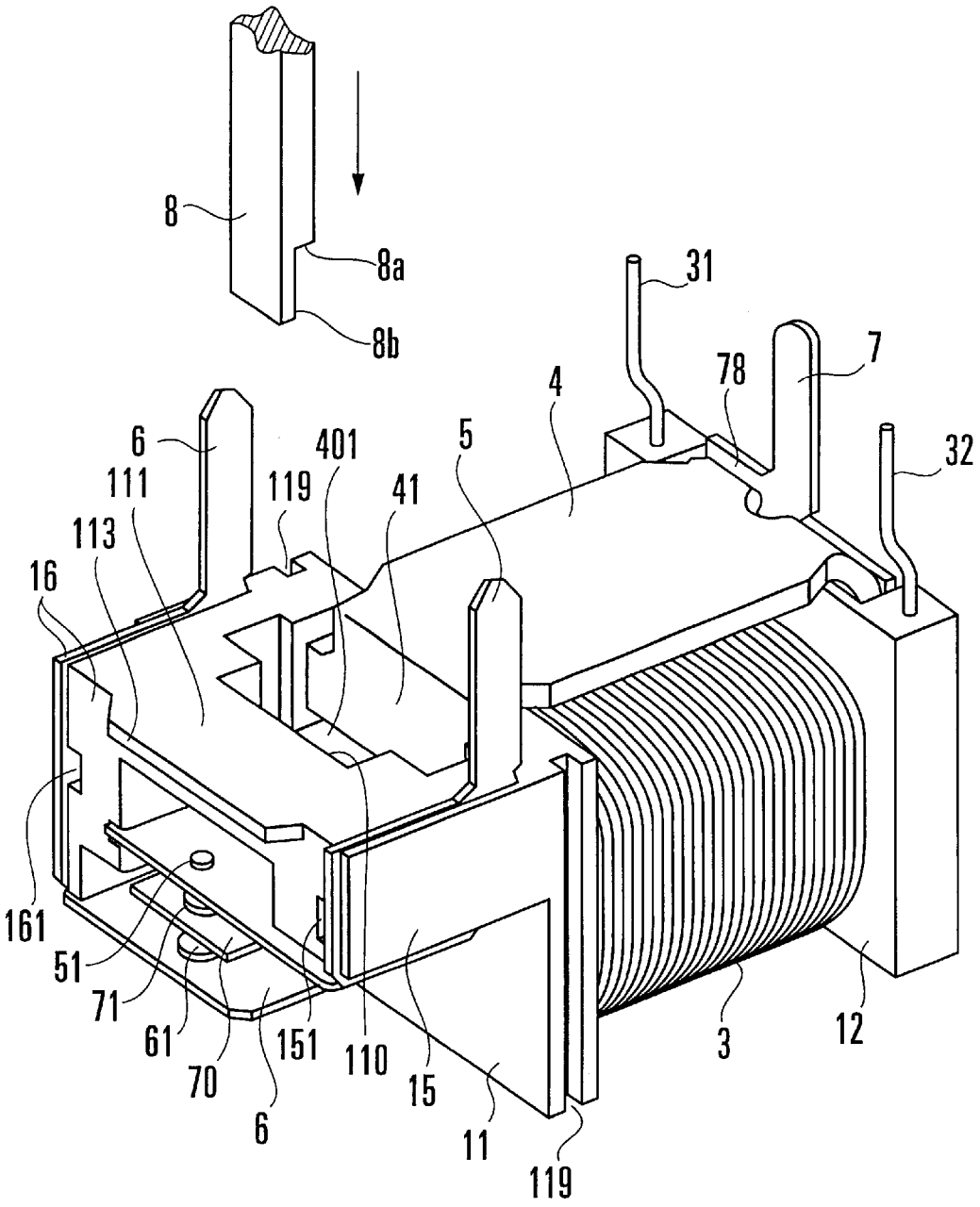
FIG. 5 is a perspective view of the electromagnetic relay shown in FIG. 4 seen from the lower side.

FIGS. 4 and 5 show a state wherein the terminal fixing portions 5*b* and 6*b* are fixed in the slits 150 and 160 by press fitting. During press fitting, projecting portions 53 and 63 formed on the front sides of the tongue pieces 52 and 62 serve to guide press fitting. When the electromagnetic relay is to be accommodated in an outer casing (not shown), grooves 119 formed in the outer side surface of the contact-side flange portion 11 fit in projections on the inner surface of the casing to position the electromagnetic relay.

A spring member 79 comprised of a movable spring 70, hinge spring 77, spring fixing portion 78, and common terminal 7 is integrally formed of a high-conductive spring material to have an L shape, and its movable contact 71 is caulked by the spring fixing portion 78. A small circular hole 74 formed in the movable spring 70 is used for spring load characteristics inspection performed after the main body is completed as well as for an adjusting method to be described later.

An armature 2 formed of a magnetic plate member of a magnetic body such as soft iron or the like has circular cylindrical projections 22 and 23 on its upper surface, as shown in FIG. 1. The projections 22 and 23 are fitted in circular holes 72 and 73 formed in the movable spring 70, and are fixed by caulking. A pawl portion 26 is formed on the end face of the armature 2 by punching halfway that portion of the armature 2 which is punched into a projection, and is used to position the end face of the yoke 4 and the armature 2.

The armature 2 connected to the hinge spring 77 through the projections 22 and 23 is inserted to extend through the hollow portion, i.e., the inner hole 10, of the spool 1. Thus, the magnetic pole surface 40 of the yoke 4 opposes the rear end face of the armature 2, and the movable contact 71 is arranged between the stationary contacts 51 and 61.

The spring fixing portion 78 is formed with a circular hole 75 in which the circular projecting portion 45 formed on the upright portion 42 of the yoke 4 is to be fitted. While the projecting portion 45 is fitted in the circular hole 75, as shown in FIG. 2, the spring fixing portion 78 is fixed to the upright portion 42 of the yoke 4 at at least one portion through a laser-welded spot 781.

The upright portions 41 and 42 of the yoke 4 are locked on the two ends of the spool 1, on which the coil is wound, by press fitting. This is disclosed in reference 1 described above. The present invention is different from reference 1 in that the pair of press-contact portions of the upright portions 41 and 42 of the yoke 4 form tapers, and that the pair of tapers are formed in opposite directions, as will be described later.

This will be described in more detail. Conventionally, the two side surfaces of the upright portions of the yoke are respectively formed with ear-like projections forming pressure-contact portions, and these projections are locked by the flange portions of the spool by press fitting. In this locking operation, the upper portions of the projections abut against projections formed on the flange portions of the spool to determine the press-fitting stroke of the yoke, thereby determining the positional relationship between the spool and the yoke.

In the yoke 4 of the present invention, as shown in FIG. 1, the two side surfaces of each of the upright portions 41 and 42 form the ear-like projections 43 and 44, which is the same as in reference 1. In the present invention, the two side surfaces of the projections 43 and 4 are tapered to gradually change the widths of the upright portions 41 and 42, thus facilitating adjustment of the contact follow.

A taper may be formed not on the two side surfaces but only on one side surface of each of the projections 43 and 44. Alternatively, tapers may be formed on the two side surfaces of one of the projections 43 and 44, and simultaneously a taper may be formed on one side surface of the other one of the projections 43 and 44.

This structure will be described with reference to FIGS. 6A to 6C.

Figure 6C:
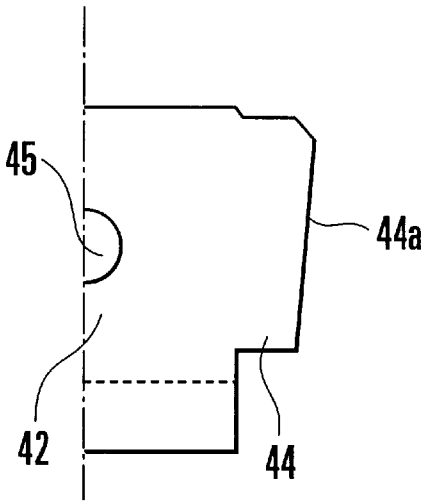
FIG. 6C is a right side view of the half surface of the yoke showing a connection side upright portion.

In the upright portion 42 of the yoke 4, tapers 44*a* are formed on its projections 44, as shown in FIG. 6C, such that the closer to the distal end of the upright portion 42, the larger the width between the two projections 44. In the upright portion 41 of the yoke 4, tapers 43*a* are formed on its projections 43, as shown in FIG. 6A, such that the closer to the distal end of the upright portion 41, the smaller the width between the two projections 43. The corner portion of the upper end of each of the projections 43 and 44 is chamfered.

Figure 6B:
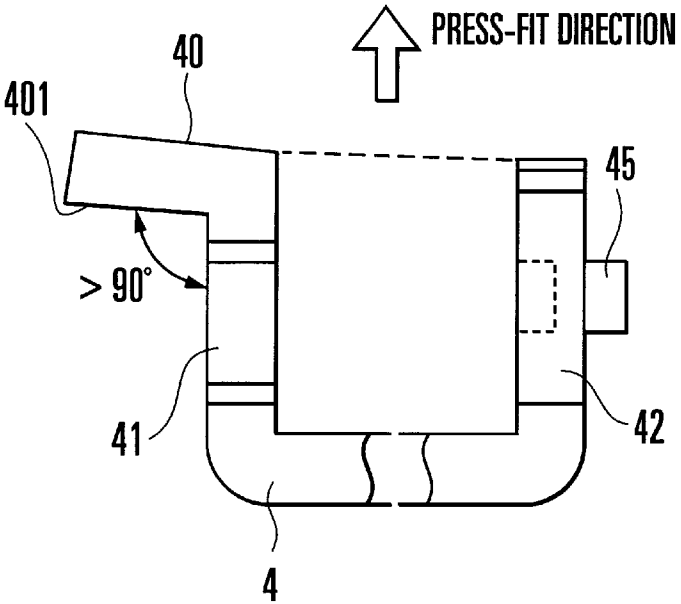
FIG. 6B is a front view of the yoke.
Figure 6A:
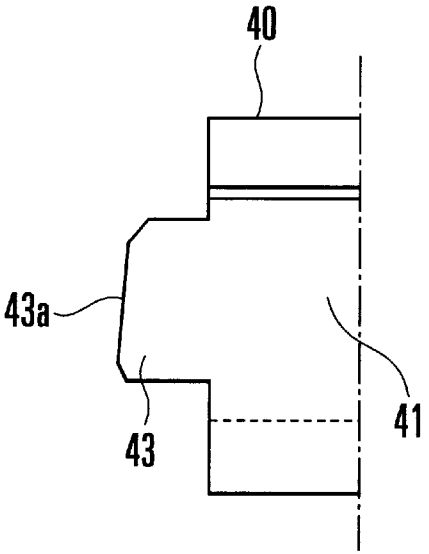
FIG. 6A is a left side view of the half surface of the yoke showing a magnetic pole surface-side upright portion.

As shown in FIG. 6B, in the magnetic pole surface 40 additionally formed on the distal end of the upright portion 41 to have a crank shape, an angle formed by a lower surface 401 of the magnetic pole surface 40 and the upright portion 41 exceeds 90° so that the distal end of the magnetic pole surface 40 is higher than the top surface of the upright portion 42. The projecting portion 45 is formed on the upright portion 42 by embossing.

The reason the yoke 4 is formed in this manner will be described.

The tapers 44*a* are formed on the projections 44 of the upright portion 42 such that their upper widths are larger than their lower widths. This is due to the following reason. When the yoke 4 is to be press-fitted into the spool 1, the upright portion 42 can be positioned first, and after that the upright portion 41 can be press-fitted into the spool 1 by pivoting it about the upright portion 42 as the pivot center.

The tapers 43*a* are formed on the projections 43 of the upright portion 41 such that their upper widths are smaller than their lower width, in order to facilitate press fitting of the upright portion 41 into the spool 1. More specifically, in temporary fixing, when the lower ends of the projections 43 are locked by the spool 1 first, the tapers 43*a* allow the bottom surface of the yoke 4 to be temporarily fixed in a tilted state such that it is high on the upright portion 42 side and low on the upright portion 41 side. In this temporary fixed state, since a coil 3 is not excited, the movable contact 71 is normally in contact with the braking side stationary contact 61.

In this embodiment, the distal end of the upright portion 41 is further bent to the contact side to form the magnetic pole surface 40 wide. Moreover, the bending angle of the distal end of the upright portion 41 is set at an obtuse angle so that the magnetic pole surface 40 can abut against the armature 2 with only its distal end portion.

In order to adjust the contact follow efficiently, the upright portion 41 of the yoke 4 need be further press-fitted into the spool 1, and the press-fit process must be ended at an optimum position. In this embodiment, as shown in FIG. 5, the adjustment efficiency is improved by utilizing a rod-shaped jig 8 having a step 8*a*. The jig 8 is inserted in an opening 110, formed in a reinforcing member 111 that reinforces a portion between the stationary terminal support portions 15 and 16 integrally formed with the flange portion 11 of the spool 1, from the lower side of the temporarily assembled electromagnetic relay.

A method of adjusting the contact follow using the jig 8 will be described with reference to FIGS. 7A to 7C and FIG. 8.

Figure 7A:
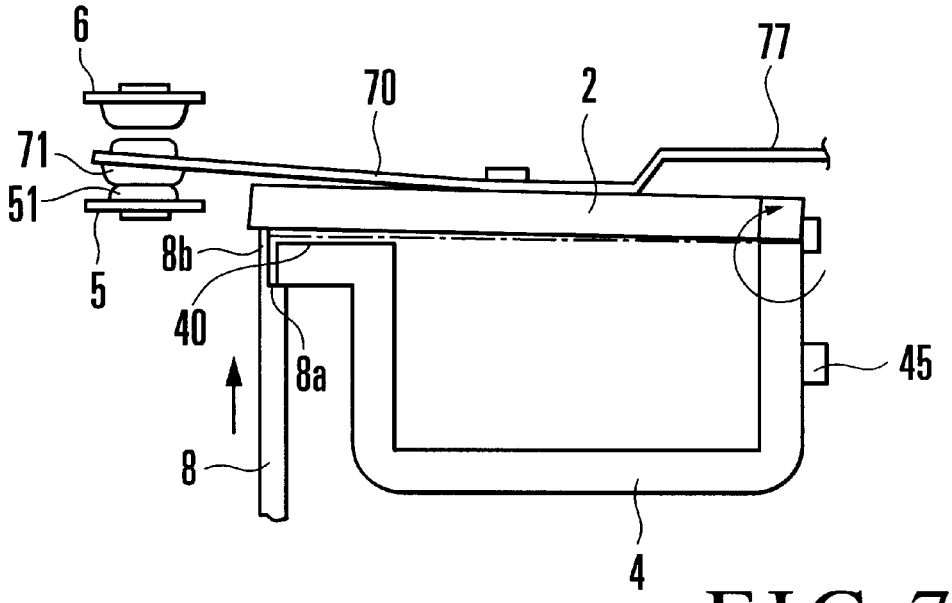
FIGS. 7A and 7B are views of a change in posture immediately after coil excitation and immediately after adjustment, respectively, to show an example of a method of adjusting the electromagnetic relay shown in FIG. 1.

As shown in FIG. 7A, the lower surface 401 of the magnetic pole surface 40 of the yoke 4 is abutted against the step 8*a* of the rod-shaped jig 8, and the coil 3 is excited to attract the armature 2 to the magnetic pole surface 40, so that the armature 2 abuts against a distal end portion 8*b* of the jig 8. In this abutting state, the jig 8 is urged, so that the upright portion 41 is further press-fitted into the spool 1. Therefore, if the size of the jig 8 from its step 8*a* to the most distal end of its distal end portion 8*b* is set to a predetermined value satisfying the adjustment value of the contact follow, the yoke 4 can be further press-fitted into the spool 1 with the distance between the magnetic pole surface 40 and armature 2 being maintained at a predetermined value.

Figure 7B:
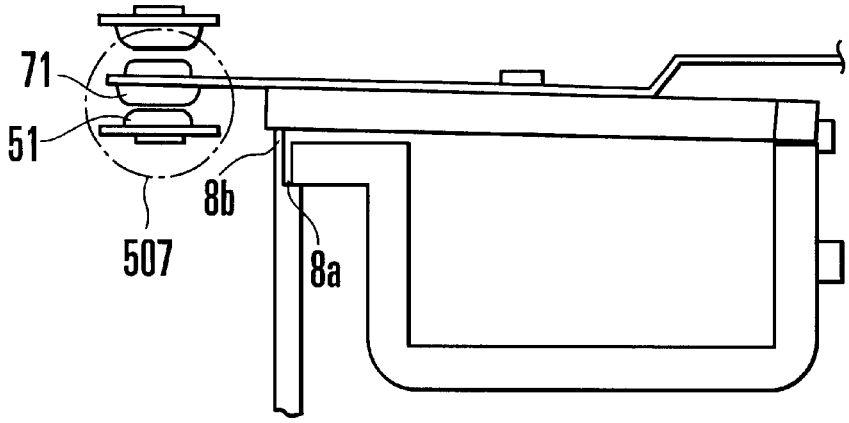
Figure 7C:
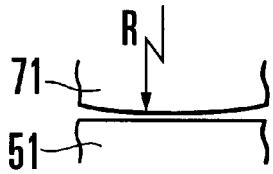
FIG. 7C is an enlarged view of the contact portion of FIG. 7B.

In this case, immediately after the coil 3 is excited, the movable contact 71 abuts against the making-side stationary contact 51, as shown in FIG. 7A, and the spring 70 of the movable contact 71 is largely deflected. After that, as the jig 8 is pushed in, deflection of the spring 70 of the movable contact 71 decreases. As shown in FIG. 7B, deflection of the movable spring 70 disappears when the movable contact 71 separates from the stationary contact 51. FIG. 7C shows a contact portion 507 of FIG. 7B in enlargement. As shown in FIG. 7C, if the push-in operation of the jig 8 is stopped when the movable contact 71 separates from the stationary contact 51, the contact follow satisfies the adjustment value.

Figure 8:
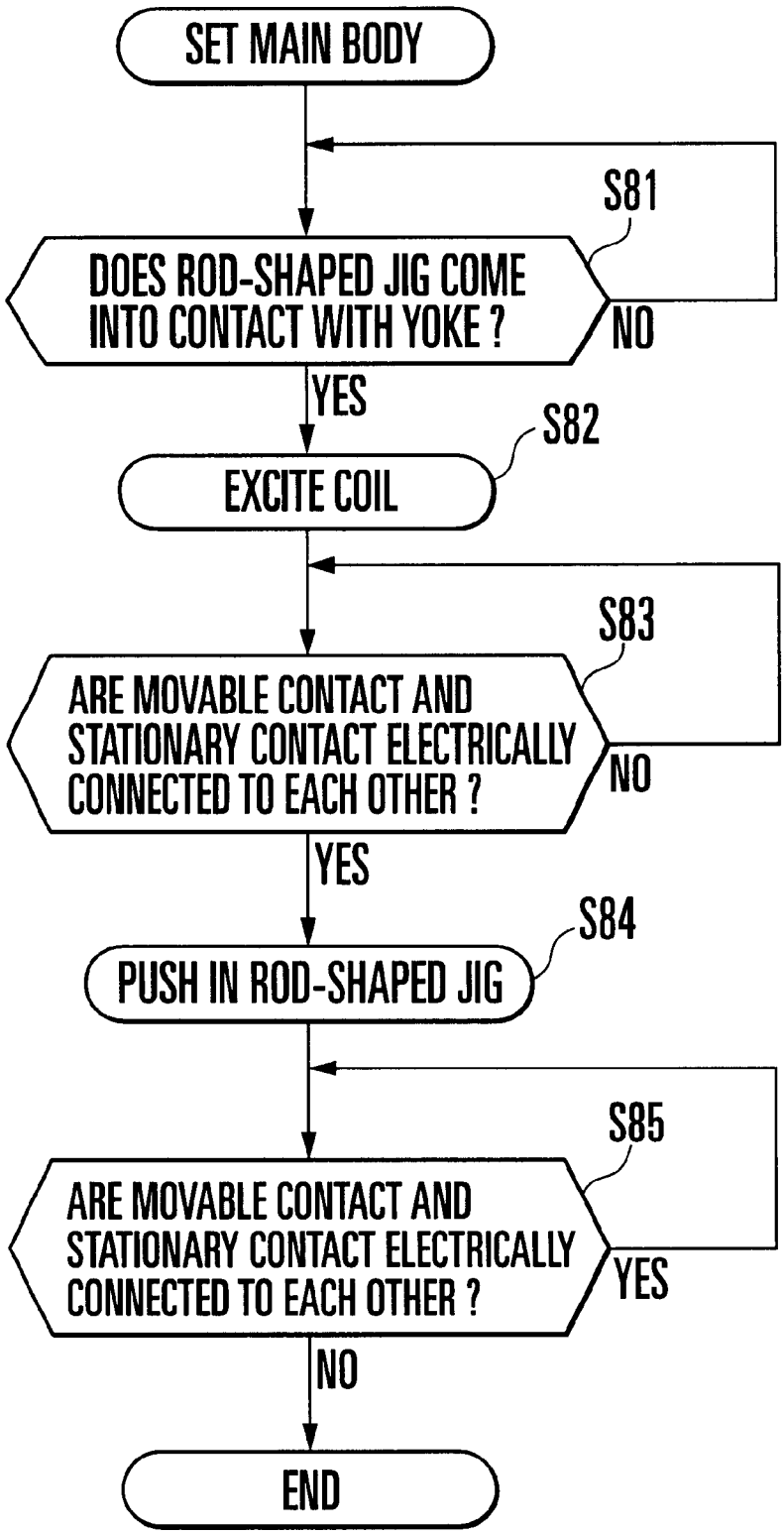
FIG. 8 is a flow chart showing the example of the method of adjusting the electromagnetic relay shown in FIG. 1.

A case wherein adjustment of the contact follow described above is performed electrically will be described with reference to the flow chart shown in FIG. 8.

First, whether the step 8*a* of the jig 8 abuts against the magnetic pole surface 40 is electrically detected (step S81). If YES, excitation of the coil 3 is started (step S82). Whether the movable contact 71 is connected to the stationary contact 51 is electrically detected (step S83). If YES, the push-in operation of the jig 8 is started (step S84). Whether the movable contact 71 has separated from the stationary contact 51 is electrically detected (step S85). If so, the push-in operation of the jig 8 is ended. Hence, the adjusting operation of the contact follow can be automated.

According to this embodiment, because of the tapers 43*a* formed on the projections 43 of the upright portion 41 of the yoke 4, the yoke 4 can be press-fitted into the spool 1 with a comparatively low resistance. Because of the presence of the tapers 43*a*, the yoke 4 will not return easily in a direction opposite to the press-fitting direction. Thus, the yoke 4 is prevented from being pushed back, after the jig 8 is removed, to cause the adjustment value of the contact follow to fluctuate.

According to the technique disclosed in Japanese Patent Laid-Open No. 6-139891 (reference 2), a gauge is interposed between the yoke and the armature, and the coil is excited, so that while the distance between the yoke and the armature is maintained at a constant value, the position of a stationary contact is changed until a movable contact separates from a making-side stationary contact, thereby adjusting the contact follow. However, in the basic structure of the electromagnetic relay described in reference 2, a stationary iron core is arranged in the coil, and the yoke has an L-shaped section. This structure is completely different from the basic structure of the present invention. Reference 2 also has the following problems.

First, to change the position of the stationary contact, the bending angle of a terminal member where the stationary contact is provided must be adjusted, or the press-fitting position of the yoke into the spool must be displaced. As the terminal member is made of a high-conductive material such as copper, its mechanical strength is inferior to that of the material of the yoke 4. Therefore, it is difficult to change only the height of the stationary contact while maintaining the central position of the stationary contact. If the terminal member is formed of a thick copper member in order to increase the mechanical strength, the material cost undesirably increases.

If the yoke 4 is adjusted to move as in the present invention, it is excellent in terms of the manufacturing cost and in the adjustment easiness, as the yoke 4 is made of inexpensive iron and is the strongest member in the electromagnetic relay. Also, an electromagnetic relay, the positional precision of which can be maintained easily and which has a high reliability, can be obtained. These effects cannot be expected from reference 2.

In reference 2, a jig for pushing the stationary contact is necessary separately from the gauge. This produces a large difference in assemble easiness when compared to a case as in the present invention, wherein the contact follow can be adjusted and the yoke can be press-fitted easily with only one jig 8.

The method of adjusting the electromagnetic relay described above will be described in more detail with reference to FIG. 9.

Figure 9:
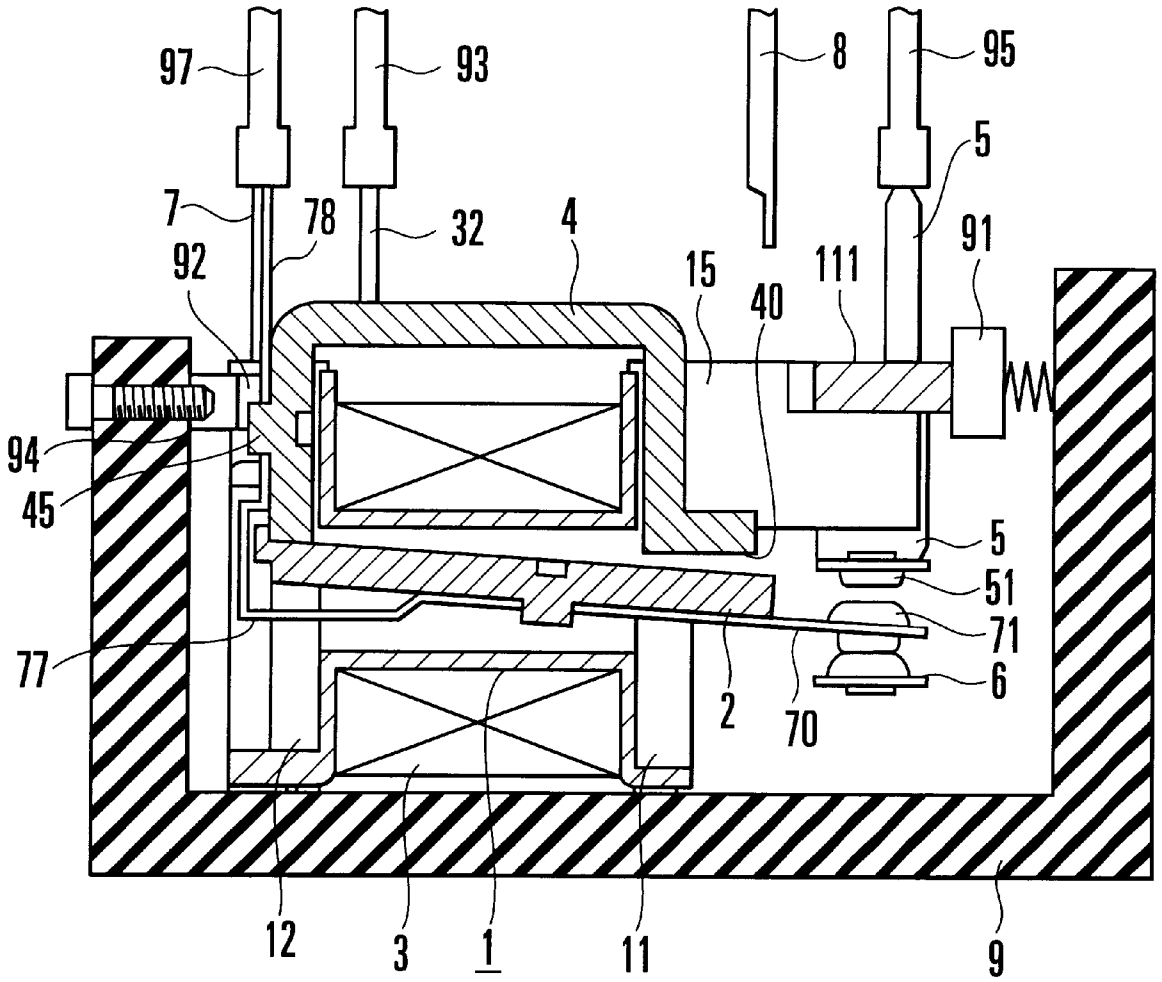
FIG. 9 is a sectional view showing the example of the method of adjusting the electromagnetic relay shown in FIG. 1.

As shown in FIG. 9, the main body of the electromagnetic relay (to be referred to as the main body hereinafter) is set on an adjusting table 9 upside down. An urging plate 91 is urged against an abutting portion 113 (FIG. 5) projecting from the reinforcing member 111 of the stationary terminal support portions 15 and 16, and the movable spring fixing portion 78 is urged against a positioning plate 92. The main body is set in this state. The positioning plate 92 has a clearance which forms a circular projecting portion 45. Since the horizontal position of the yoke 4 is determined by the positioning plate 92 through the spring fixing portion 78, the positioning precision of the jig 8 and the distal end of the magnetic pole surface 40 is ensured.

Horizontal fine adjustment of the set main body is performed by adjusting the thickness of a spacer 94 interposed between the adjusting table 9 and positioning plate 92. A probe 93 abuts against one coil terminal 32 in order to energize the coil 3, while a probe 95 abuts against the stationary contact terminal 5 in order to detect that the making-side stationary contact 51 is turned on. Although not shown, a probe is naturally present for energizing the other coil terminal 31 in order to excite the coil 3.

Figure 10:
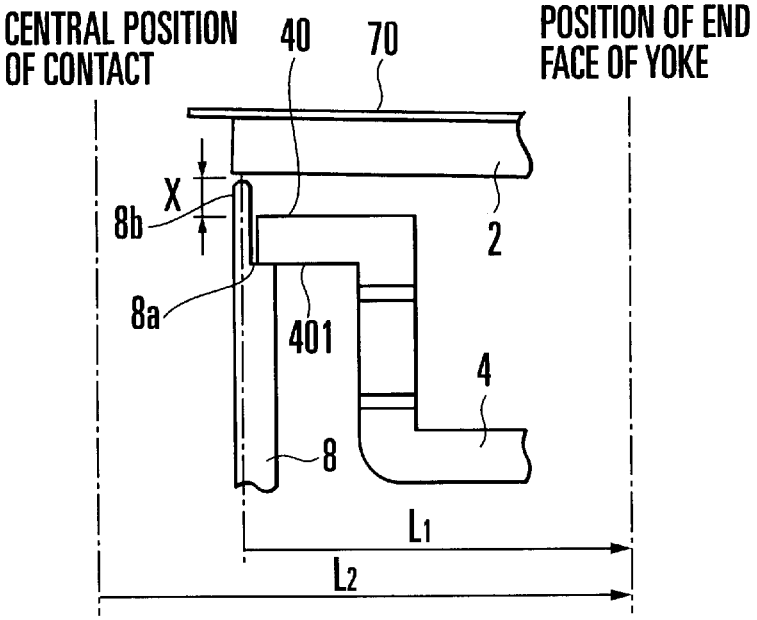
FIG. 10 is an enlarged view of the distal end portion and the magnetic pole surface of the yoke for explaining an example of an adjusting method according to the present invention in detail.

Before exciting the coil 3, as shown in FIG. 10, the jig 8 is set such that its step 8*a* abuts against the lower surface 401 of the magnetic pole surface 40 of the yoke 4, and that its distal end portion 8*b* comes close to the distal end portion of the armature 2. A projecting height (length) X of the distal end portion 8*b* from the magnetic pole surface 40 and a contact follow Xm satisfy a constant correlation, and this relationship can be expressed as:

$$X=(L1/L2)*Xm \quad (1)$$

where L1 is the distance from the pivot center of the armature 2 on the upright portion 42 side of the yoke 4 to the center of the distal end portion 8*b* of the jig 8 in the longitudinal direction, and L2 is the distance from this pivot center to the center of the contacts 51, 61, and 71.

Therefore, the actual length from the step 8*a* of the jig 8 to the most distal end of the distal end portion 8*b* becomes the sum of the length X and the plate thickness of the yoke 4. Variations in plate thickness of the yoke 4 may produce an adjustment error. However, this adjustment error is as small as about several $\mu$m at maximum and negligible accordingly.

When the coil 3 is excited, the distal end portion of the armature 2 abuts against the distal end portion 8*b* of the jig 8, and the gap between the magnetic pole surface 40 and the distal end portion of the armature 2 becomes equal to X. Thus, the contact follow Xm is ensured. The distal end portion of the armature 2 is exposed from the distal end of the magnetic pole surface 40 so as to abut against the distal end portion 8*b* of the jig 8. The distal end portion of the armature 2 preferably overlaps the distal end portion 8*b* of the jig 8 by 0.2 mm or more. The distal end of the magnetic pole surface 40 of the yoke 4 is preferably set higher than the top surface of the upright portion 42 by several $\mu$m.

Hence, the abutting position of the yoke 4 with the armature 2 can always be specified and set at one constant portion on the end portion of the magnetic pole surface 40. In the adjustment position shown in FIG. 10, constant contact follow adjustment is accordingly enabled.

The projecting heights of the projections 43 and 44 of the upright portions 41 and 42 are about 1 mm, and the angles of the tapers formed on the end faces of the projections 43 and 44 are 1° to 2° with respect to the press-fitting direction. As described above, the upright portion 41 is formed with the taper surfaces in the forward direction with respect to press fitting, and the upright portion 42 is formed with the taper surfaces in a direction opposite to the taper surfaces of the upright portion 41.

The cut surfaces formed on the upper ends of the projections 44 allow the upright portion 42 to be press-fitted into the spool 1 smoothly. Also, due to the opposite-direction tapers of the upright portion 41, the fitting hold portion between the yoke 4 and spool 1 is set close to the upper end portions of the projections 44. Therefore, the posture of the yoke 4 during contact follow adjustment changes about this fitting hold portion as the rotation center, so no excessive press-fitting force is required.

The opening 110 of the spool 1 where the jig 8 is to be inserted is formed large, as shown in FIGS. 3 and 5, to facilitate insertion of the jig 8. Since the opening 110 is formed large to remove unnecessary portion, a change in size caused by a sink mark formed while molding the spool 1 from an insulating resin can be prevented.

Figure 11:
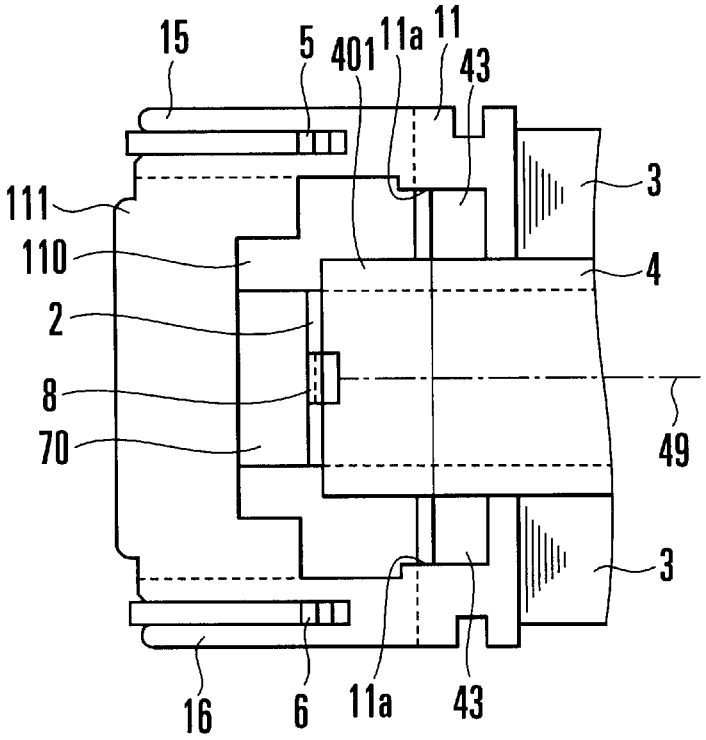
FIG. 11 is a bottom view showing how a jig is inserted in the electromagnetic relay shown in FIG. 1.

FIG. 11 shows, from the lower side, a state wherein the yoke 4 is press-fitted into the flange portion 11 of the spool 1. As is apparent from FIG. 11, the pair of projections 43 formed on the yoke 4 are fitted on inner wall surfaces 11*a* of the flange portion 11 by press fitting. When the inserting position of the jig 8 is set to coincide with a center line 49 of the yoke 4 in the longitudinal direction, the magnetic pole surface 40 is prevented from being inclined when the yoke 4 is pushed in.

A method of adjusting an electromagnetic relay according to the second embodiment of the present invention will be described with reference to FIGS. 12A and 12B, FIGS. 13A to 13C, and FIG. 14.

Figure 12A:
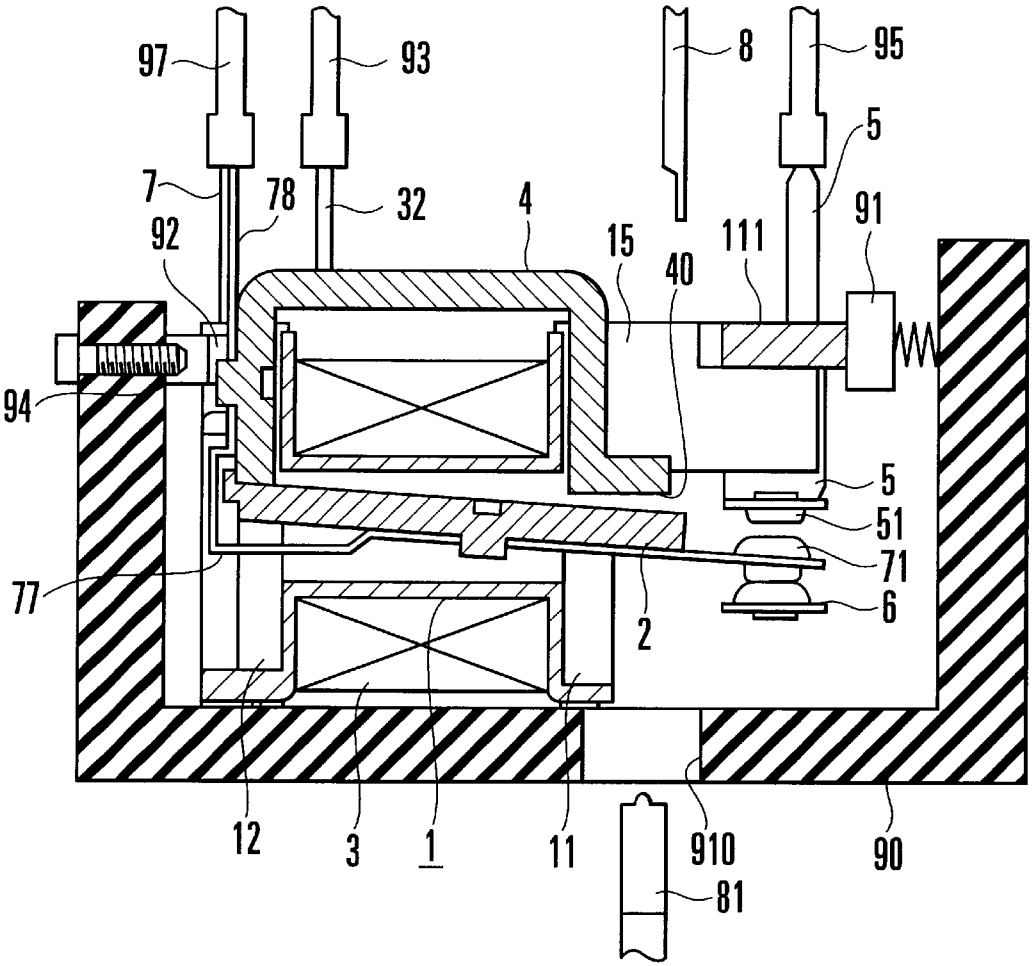
FIG. 12A is a sectional view showing another example of the method of adjusting the electromagnetic relay shown in FIG. 1.
Figure 12B:
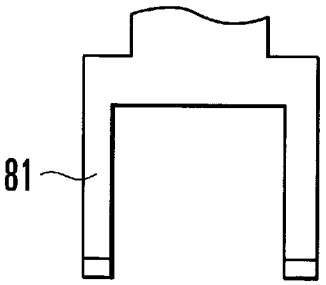
FIG. 12B is a plan view of the push-back jig shown in FIG. 12A.

Referring to FIG. 12A, a main body is set on an adjusting table 90 in the same manner as in the first embodiment. As shown in FIG. 12B, a push-back jig 81 having a forked distal end is located on a side opposite to a rod-shaped jig 8 through a magnetic pole surface 40. The adjusting table 90 is formed with an opening 910 through which the push-back jig 81 is to extend. The relationship among the respective probes and the terminals of the main body is identical to that shown in FIG. 9, and accordingly these portions are denoted by the same reference numerals as in FIG. 9 and a detailed description thereof will be omitted.

Figure 13A:
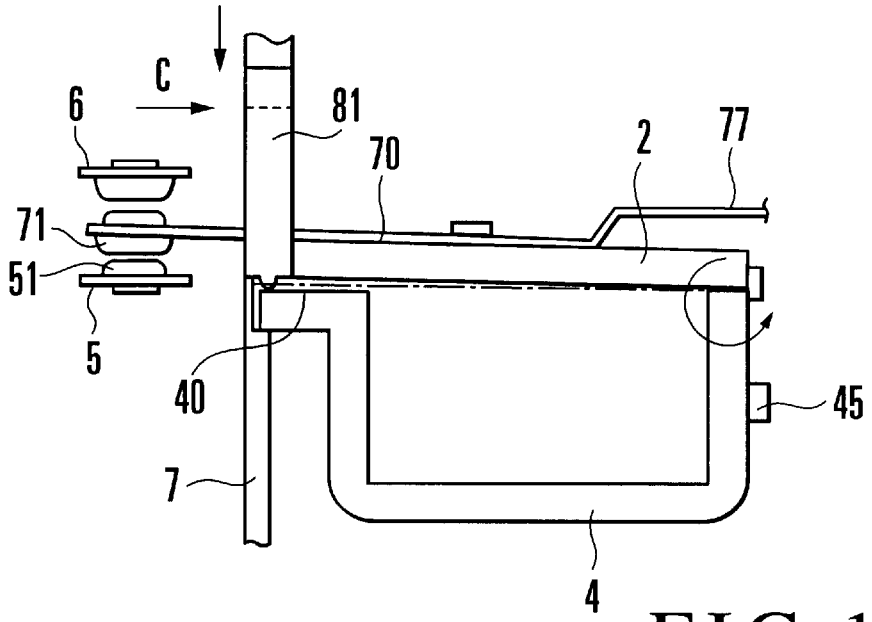
FIGS. 13A and 13B are views of a change in posture immediately after coil excitation and immediately after adjustment, respectively, to show another example of a method of adjusting the electromagnetic relay shown in FIG. 1.

FIG. 13A shows a case wherein, in the stage of temporarily fixing a yoke 4, the yoke 4 is excessively press-fitted into a spool 1 with the jig 8. The magnetic pole surface 40 side of the yoke 4 is excessively press-fitted by about 0.15 mm with reference to the yoke end face side as the zero reference. When the two end portions at the distal end of the magnetic pole surface 40 are pushed back as will be described later, the press-fitted state of the yoke 4 is adjusted, so that the contact follow can be finally adjusted.

Figure 14:
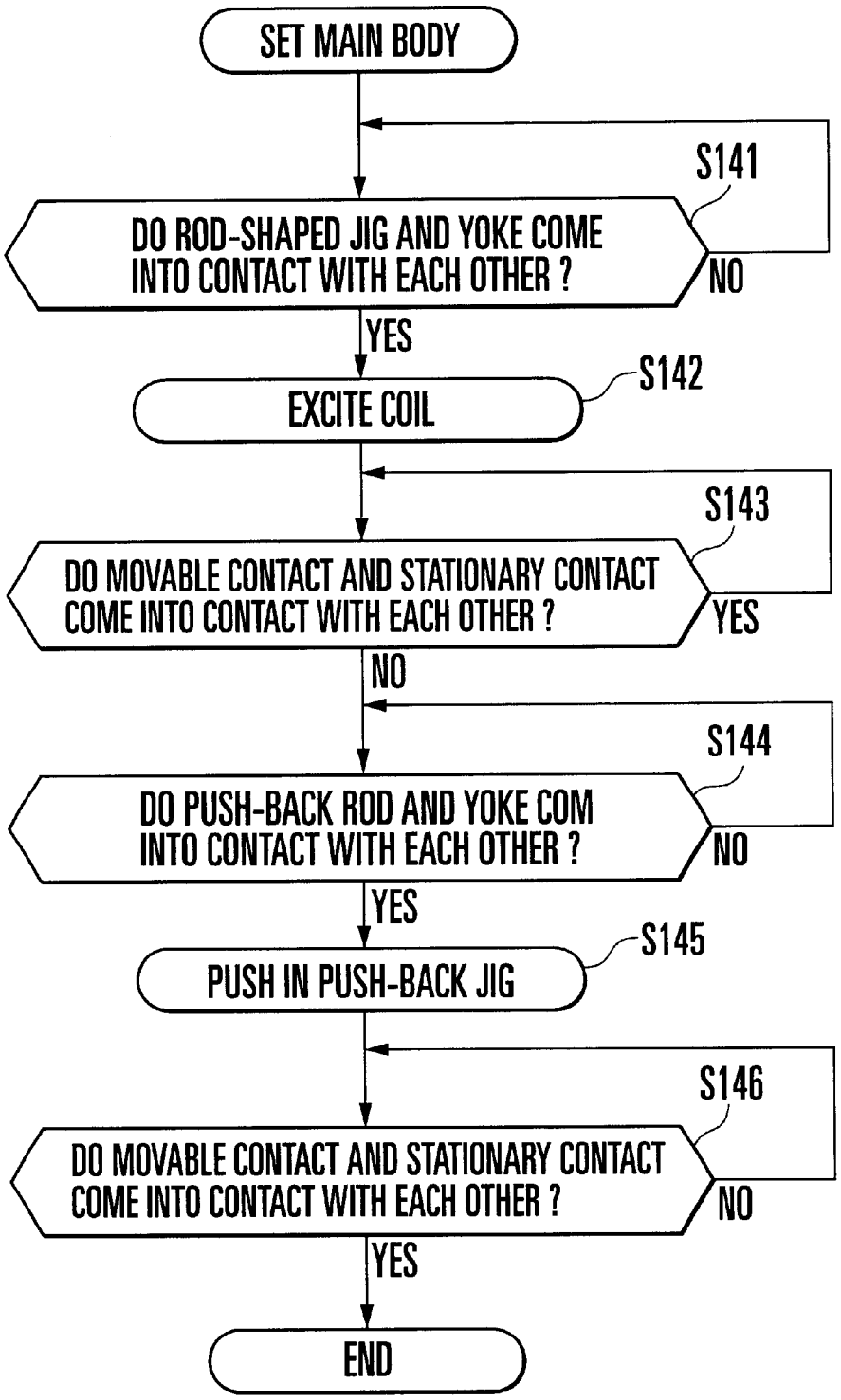
FIG. 14 is a flow chart showing another example of a method of adjusting the electromagnetic relay shown in FIG. 1.

As shown in FIG. 14, first, contact between a step 8*a* of the jig 8 and the yoke 4 is electrically checked (step S141). A coil is excited to attract the distal end portion of an armature 2 to the magnetic pole surface 40 side (step S142). A gap X corresponding to a desired contact follow is formed between the armature 2 and magnetic pole surface 40, as described with reference to FIG. 10.

The non-contact state between a movable contact 71 and a making-side stationary contact 51 is electrically detected (step S143) to check whether the contact follow is present within the adjustment range. In this case, if the contact is made, it suggests that the contact follow is present outside the adjustment range.

The contact between the push-back jig 81 and magnetic pole surface 40 is electrically checked (step S144). If YES, the magnetic pole surface 40 is pushed in by the push-back jig 81 (step S145), so that the yoke 4 is displaced while maintaining the gap X. More specifically, the yoke 4 is displaced while rotating, about an upright portion 42 as the center, in a direction opposite to the direction in which the yoke 4 is rotated when it is pushed in by the jig 8. Along with this displacement, the armature 2 is also displaced. Whether the movable contact 71 comes into contact with the stationary contact 51 is electrically detected (step S146). If YES, the push-in operation of the push-back jig 81 is ended. The press-fitting adjustment operation of the yoke 4 is thus completed.

Figure 13B:
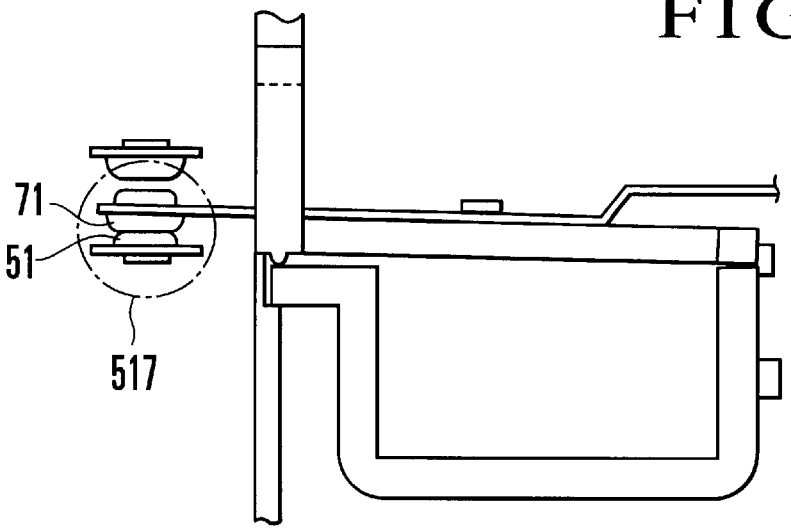
Figure 13C:
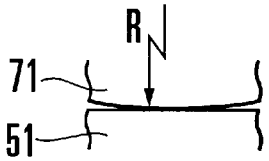
FIG. 13C is an enlarged view of the contact portion of FIG. 13B.

FIG. 13B shows a wherein this press-fitting operation is completed, and FIG. 13C shows a contact portion 517 in this state in enlargement. As shown in FIG. 13B, although a movable spring 70 is not deflected, a desired contact follow can be obtained with a gap formed by the jig 8. In order to increase the adjustment precision, the push-in speed of the push-back jig 81 is preferably set constant, and a speed of about 0.07 mm/sec after the push-back jig 81 comes into contact with the yoke 4 is appropriate.

In the second embodiment in which the contact follow is adjusted by pushing back the yoke 4, the distal end portion of the armature 2 may be pushed in through a small circular hole 74 of the movable spring 70, in place of the push-back jig 81. In this case, a thin wire-shaped push-back jig is used. As shown in FIG. 4, a notch 6a may be formed in the upper surface portion of a stationary contact terminal 6 so the small circular hole 74 can be seen through it.

In the above description, tilted surfaces, i.e., tapers 43*a*, are formed on an upright portion 41 and the upright portion 42 of the yoke 4 locked by press fitting on flange portions 11 and 12 of the spool 1 to stride over the coil 3. To effect press fitting, tapers may be formed on the flange portions 11 and 12 of the spool 1. Alternatively, the tapers may be formed on both the upright portions 41 and 42 and the flange portions 11 and 12

From the viewpoint of machining precision, it is preferable to form tapers on the yoke 4 which can be formed by punching a metal. In particular, resin molding of the spool 1 has a machining precision poorer than that of metal machining, and depending on the directions of the tapers, it is sometimes difficult to remove the spool 1 from the mold. Therefore, the tapers are preferably formed on the yoke 4.

Regarding the shape of the tapers of the upright portion 42, an inverted trapezoid shape as shown in FIG. 6C is preferable so that, in the flange portion 12 of the spool 1, the closer the upright portion 42 of the yoke 4 is to a hollow portion 10 of the spool 1, the larger the locking force. This is because of the following reason. If the upright portion 41 of the yoke 4 can move in the flange portion 11 of the spool 1 by pivoting about the Connecting portion of the armature 2 and yoke 4 as the center, the adjustment precision is increased, so that the adjusting operation can be performed more easily.

When a tilt is to be formed on at least one of the flange portion 11 of the spool 1 and the upright portion 41 of the yoke 4, a tilt with which the locking force on a side separate from the hollow portion 10 of the spool 1 is larger than that on the press-fitting distal end side closer to the hollow portion 10, i.e., a tilt tilted in a direction opposite to that of the tilt formed on the upright portion 42, is preferable.

As shown in FIG. 1, the flange portion 12 of the spool 1 is formed with a projecting portion 124 projecting toward the hollow portion 10 so as to regulate the upper limit of the press-fitting position of the upright portion 42 of the yoke 4.

Figure 15A:
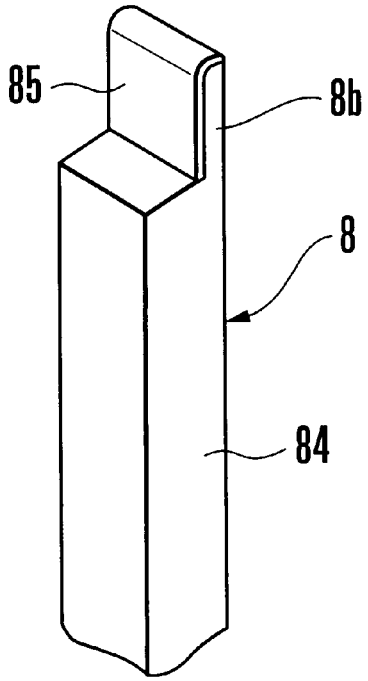
FIGS. 15A and 15B are perspective views showing modifications to the jig.
Figure 15B:
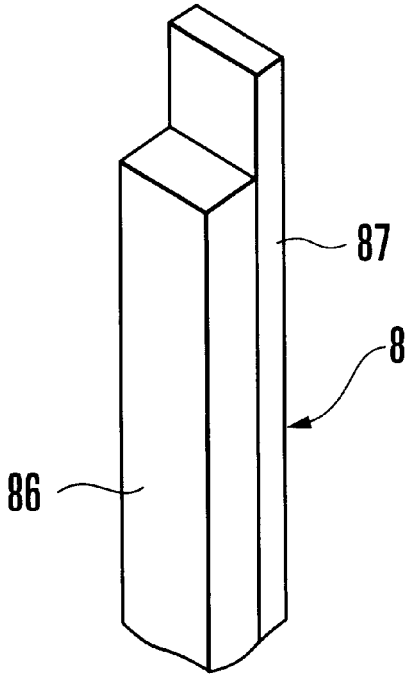

The jig 8 may be fabricated from a steel stock having a high strength, but is not limited to this. When contact between the yoke 4 and jig 8 is to be checked through electrical contact between them, the jig 8 is preferably formed of a conductive, high-strength metal member. If the jig 8 erroneously comes into contact with the armature 2 before the yoke 4, this may be electrically, erroneously determined that that the jig A has come into contact with the yoke 4. In order to avoid this, a distal end portion 8*b* of the jig 8 formed of a metal rod 84 may be made of an insulating member, or as shown in FIG. 15A, only the distal end portion 8*b* of the metal rod 84 may be covered with an insulating film 85. Alternatively, as shown in FIG. 15B, the jig 8 may be formed of a laminated structure of a metal plate 86 and an insulating plate 87 longer than the metal plate 86 by its distal end portion.

A practical example of the present invention will be described in detail with reference to FIGS. 1 and 2.

First, nickel silver (Ni-Cu alloy) coil terminals 31 and 32 each having a diameter of 0.56 mm are press-fitted in a spool 1 made of polybutylene terephthalate (30%-glass reinforced). Each of rotation preventive squeezed portions 33 and 34 has a length of 1 mm and a width of 0.65 mm with respect to the corresponding press-fit hole (with a diameter of 0.6 mm) of the spool 1. Coil tie-up portions 35 and 36 have a length of 1.5 mm. A coil 3 made of a polyurethane-covered copper wire is tied up on the coil tie-up portion 36. The coil 3 is then wound on the spool 1, and is tied up on the coil tie-up portion 35. After that, the two coil tie-up portions 35 and 36 are soldered.

The two ends of an electromagnetic soft-iron plate (thickness: 1 mm) are bent at substantially a right angle to form a yoke 4 having a U-shaped section. One end of this structure is further bent back at 90.5° to form a magnetic pole surface 40. Positioning is performed with respect to the yoke 4 by using the two side surfaces of each of upright portions 41 and 42 as the press-fit surfaces and the two abutting surfaces above the press-fit surfaces. A projecting portion 45 is formed by embossing, as shown in FIG. 6B, to have a diameter of 1 mm and a height of 0.8 mm. The taper angle of projections 43 and 45 is 1.6° with respect to the press-fit direction.

A pair of stationary contact terminals 5 and 6 are formed from a 0.4-mm thick high-conductivity copper lead frame member by bending to have an L-shaped section each. Stationary contacts 51 and 61 are caulked on contact support portions 5*a* and 6*a*. Terminal fixing portions 5*b* and 6*b* are cut and raised in a cantilevered manner to form tongue pieces 52 and 62, respectively, each having a width of 1 mm and a length of 1 mm to 2 mm.

An armature 2 made of an electromagnetic soft-Iron plate (thickness: 1 mm) has two projections 22 and 23 (diameter: 1 mm; height: 0.5 mm) formed by embossing at substantially its central region. The projections 22 and 23 are respectively connected to circular holes 72 and 73 of a movable spring 70. The projection 22 is merely fitted in the circular hole 72 so as to be utilized for positioning the armature 2 and movable spring 70 with each other. The projection 23 is caulked in the circular hole 73.

A pawl portion 26 is formed by punching only half the plate thickness separately from the portion of the armature 2 which is formed into the projecting shape by press punching, and is used for positioning the armature 2 and the end face of the yoke 4 with each other.

A spring member 79 comprised of the movable spring 70, a hinge spring 77, a spring fixing portion 78, and a common terminal 7 is integrally press-punched from a high-conductive copper spring member having a thickness of 0.14 mm. A movable contact 71 is formed on the spring member 79 by caulking, and thereafter the hinge spring 77 and common terminal 7 are bent at predetermined angles, thereby completing the spring member 79. A small circular hole 74 formed in the movable spring 70 near the contact side is used for inspection of the load characteristics which is performed after the main body is completed.

The yoke 4 is pressed into the spool 1 and temporarily fixed to it by using the two side portions of each of the upright portions 41 and 42. In this case, the upper limit of press fitting of the shoulder portions of the upright portion 42 is determined by a projecting portion 124 formed on a flange portion 12 of the spool 1. Although the upright portion 41 of the yoke 4 is press-fitted into the press-fit portion of a flange portion 11 of the spool 1, it is not press-fitted into the deepest end, but is temporarily fixed halfway. The flange portions 11 and 12 of the spool 1 and the projections 43 and 44 of the upright portions 41 and 42 of the yoke 4 are fitted with each other through interference fit achieved by setting the maximum width of the upright portions 41 and 42 of the yoke 4 to be larger than the inner diameter of the flange portion 11 by about 70 $\mu$m.

The hinge spring 77 produces the spring function effect of biasing the distal end of the armature 2 in a direction to separate from the magnetic pole surface 40 of the yoke 4. The hinge spring 77 is formed with a rectangular opening 76 to expose the pawl portion 26.

The distal end of the armature 2 connected to the hinge spring 77 is inserted in a hole 10, having a rectangular section, in the spool 1. At this time, the rear end face of the yoke 4 and the rear end of the armature 2 are aligned, and the movable contact 71 is arranged between the stationary contacts 51 and 61.

The spring fixing portion 78 is formed with a circular hole 75 in which the projecting portion 45 of the yoke 4 is to be inserted and positioned. The projecting portion 45 and circular hole 75 are fitted with each other, and the spring fixing portion 78 is fixed to the upright portion 42 of the yoke 4 at two spot-welded spots 781 with a laser beam.

Subsequently, as shown in FIG. 9, the main body is turned upside down, and is placed on an adjusting table 9. Before exciting the coil 3, a step 8*a* of a jig 8 abuts against a lower surface 401 of the magnetic pole surface 40 of the yoke 4, and a distal end portion 8*b* of the jig 8 comes close to the distal end portion of the armature 2.

The distal end portion of the armature 2 is exposed from the distal end of the magnetic-pole surface 40 so as to abut against the distal end portion 8*b* of the jig 8, and overlaps the distal end portion 8*b* of the jig 8 by 0.3 mm.

The yoke 4 is press-fitted obliquely (=temporarily press-fitted) with a shortage of about 0.15 mm on the magnetic pole surface 40 side with reference to the rear end face side of the yoke 4 as the zero reference. In adjustment of the electromagnetic relay according to the present invention, the contact follow is adjusted by fine-adjusting the press-fit posture of the yoke 4 from this state .

The push-in speed of the jig 8 is about 0.07 mm/sec after the jig 8 comes into contact with the yoke 4. This is also a measure f or improving the adjustment precision . In the case of a shortage of press fitting described above, adjustment is ended about 2 sec after the push-in operation of the jig 8 is started.

In FIG. 13A, assume that the magnetic pole surface 40 side is excessively press-fitted by about 0.15 mm with reference to the end face side of the yoke 4 as the zero reference. The push-in speed of a push-back jig 81 is about 0.07 mm/sec after the push-back jig 81 comes into contact with the yoke 4. This is a measure for improving the adjustment precision, in the same manner as in the first embodiment.

With the present invention, according to the first effect, the contact follow becomes uniform.

Conventionally, the contact follow varies by about 20 $\mu$m, whereas with the adjusting method of the present invention, the contact follow varies by less than 10 $\mu$m, and accordingly the variation amount is reduced to less than ¼ that of the conventional case. This is because of the following reason. Since press-fitting of the yoke is adjusted after a predetermined gap is maintained by using the rod-shaped jig, variations In press-fit position and variations in machining of the built-in components can be absorbed.

According to the second effect, since the contact follow becomes uniform, the service life is stabilized.

According to the third effect, since the contact follow is uniform, the contact travel is stabilized, so that the working voltage is stabilized.

What is claimed is:

1. An electromagnetic relay comprising:

a spool having a hollow portion and first and second flange portions formed at two ends thereof;

a coil wound on said spool;

a U-shaped yoke locked at said flange portions of said spool by press fitting to stride over said coil;

an armature movably connected to one end of said yoke and positioned to extend through said hollow portion of said spool;

a movable contact attached to move in an interlocked manner with said armature;

a pair of stationary contacts arranged to sandwich said movable contact; and a first taper portion formed on at least one of press-fit locking surfaces of one end of said yoke and said first flange portion and having a locking force that increases as being closer to a vicinity of said hollow portion of said spool.

2. A relay according to claim 1, further comprising a second taper portion formed on at least one of press-fit locking surfaces of the other end of said yoke and said second flange portion and having a locking force that increases as being farther from said hollow portion of said spool.

3. A relay according to claim 1, wherein said first flange portion has a projecting portion that defines an upper limit of a press-fit position of said one end of said yoke.

4. A relay according to claim 1, wherein said yoke has first and second upright portions formed by bending two ends of a plate member, said first and second upright portions having opposing surfaces which abut against said first and second flange portions, respectively, said first upright portion has a first projection on at least one of side portions thereof to project in a direction substantially perpendicular to an extending direction of said hollow portion, and said first taper portion is formed on said first projection such that a width of said first upright portion including said first projection decreases from an upper portion toward a lower portion thereof.

5. A relay according to claim 4, wherein said second upright portion has a second projection on at least one of side portions thereof to project in a direction substantially perpendicular to an extending direction of said hollow portion, and said second projection has a second taper portion formed such that a width of said second upright portion including said second projection decreases from an upper portion toward a lower portion thereof.

6. A relay according to claim 4, further comprising a plate spring member comprised of a movable spring formed with said movable contact and a spring fixing portion for supporting said movable spring in an L shape manner, said movable spring being fixed on said armature, and said spring fixing portion being fixed to said first upright portion to stride over a connecting portion of said yoke and said armature.

7. A relay according to claim 6, wherein said plate spring member is fixed to said first upright portion by laser welding.

8. A relay according to claim 4, wherein said second upright portion has a bent portion which is bent outward to form a magnetic pole surface, said bent portion is arranged such that a distal end thereof is located inside a distal end of said armature, and said yoke is press-fitted into said flange portion with a distance between said magnetic pole surface and said distal end of said armature being maintained at a predetermined value.

9. A relay according to claim 8, wherein said second upright portion and said bent portion forms an obtuse angle, and only said distal end of said bent portion abuts against said armature.

10. A relay according to claim 4, wherein said bent portion has a width which is set larger than a width of a distal end portion of said armature, and said second upright portion is pushed back by a jig from an armature side.

11. A method of adjusting an electromagnetic relay having a spool having a hollow portion, a coil wound on said spool, a U-shaped yoke having a magnetic pole surface on one end thereof and fixed to two end portions of said spool, an armature movably connected to one end of said yoke and positioned to extend through said hollow portion of said spool, a movable contact attached to move in an interlocked manner with said armature, and a pair of stationary contacts arranged to sandwich said movable contact and including a making contact, comprising the steps of:

pushing said yoke into said spool until reaching a temporary fixing position, exciting said coil at said temporary fixing position, thereby maintaining a predetermined gap between said armature and said magnetic pole surface of said yoke, and determining a press-fit position of said yoke, while said predetermined gap is maintained, in accordance with presence/absence of contact between said movable contact and said making contact, thereby adjusting a contact follow.

12. A method according to claim 11, wherein the determining step comprises the steps of further pushing said yoke in a press-fit direction, while said predetermined gap is maintained, from said temporary fixed position by using a push-in jig having a step portion, and completing push-in operation of said yoke when said movable contact is disconnected from said making contact.

13. A method according to claim 12 wherein, while a distal end of said magnetic pole surface of said yoke and a distal end of said armature are displaced from each other, a distal end of said push-in jig abuts against a lower surface of said armature, and said step portion of said push-in jig abuts against a lower surface of said yoke, so that said predetermined gap is maintained.

14. A method according to claim 13, wherein a push-back jig abuts against two side portions of said yoke exposed from said armature.

15. A method according to claim 13, wherein said yoke starts push-back operation when contact between said push-back jig and said yoke is detected.

16. A method according to claim 12, wherein a surface of a distal end of said push-in jig which opposes an end face of said yoke is made of an insulator, and said step portion which comes into contact with a lower surface of said yoke is made of a conductor.

17. A method according to claim 16, wherein said coil is excited when electrical contact between said step portion of said push-in jig and said yoke is detected.

18. A method according to claim 11, wherein the determining step comprises the steps of pushing back said yoke, which is excessively press-fitted, in a counter press-fit direction by using a push-back jig while said predetermined gap is maintained, and completing push-back operation of said yoke when said movable contact comes into contact with said making contact.

19. A method of assembling an electromagnetic relay, comprising the steps of:

temporarily fixing a U-shaped yoke to two end portions of a spool, having a coil, by press fitting;

forming an integral structure in which a proximal end portion of an armature extending through a hollow portion of said spool is connected to one end of said yoke and a spring member, which biases said armature in such a direction that a distal end portion thereof opens from the other end of said yoke, is fixed to said yoke and said armature;

press-fitting one end of said yoke into a first flange portion of said spool, and temporarily fixing said yoke such that the other end of said yoke pivots about one end of said yoke as a rotation center; and after temporary fixing, with a distance between the other end of said yoke and a distal end portion of said armature being maintained to a predetermined value, press-fitting said yoke into said second flange of said spool while adjusting the other end of said yoke.

20. A method according to claim 19, wherein the forming step comprises the steps of fixing said armature and said spring member by caulking, and fixing said spring member and said yoke by laser welding.

21. A method according to claim 20, wherein laser welding is performed after caulking.

* * * * *